US005450825A

United States Patent [19]

Geyer et al.

[11] Patent Number: 5,450,825

[45] Date of Patent: Sep. 19, 1995

[54] METHOD FOR ACTIVATING A DEVICE FOR THE RELATIVE ROTATION OF A SHAFT AND DEVICE FOR THE RELATIVE ROTATION OF THE SHAFT OF AN INTERNAL COMBUSTION ENGINE

[75] Inventors: Gerhard Geyer, Munich; Johann Mendle, Wörth, both of Germany

[73] Assignee: Robert Bosch GmbH, Stuttgart, Germany

[21] Appl. No.: 256,309

[22] PCT Filed: Oct. 22, 1993

[86] PCT No.: PCT/DE93/01005

§ 371 Date: Jul. 5, 1994

§ 102(e) Date: Jul. 5, 1994

[87] PCT Pub. No.: WO94/10429

PCT Pub. Date: May 11, 1994

[30] Foreign Application Priority Data

Nov. 4, 1992 [DE] Germany ..... 42 37 193.7

[51] Int. Cl.[6] ..... F01L 1/34; F16D 3/10; G05D 13/40

[52] U.S. Cl. ..... 123/90.17; 123/90.31; 464/2; 74/568 R

[58] Field of Search ..... 123/90.15, 90.17, 90.31; 464/1, 2, 160; 74/568 R, 567

[56] References Cited

U.S. PATENT DOCUMENTS

| | | | |
|---|---|---|---|
| 5,189,999 | 3/1993 | Thoma | 123/90.17 |
| 5,247,914 | 9/1993 | Imai et al. | 129/90.17 |
| 5,305,718 | 4/1994 | Müller | 123/90.17 |
| 5,311,846 | 5/1994 | Muller | 123/90.17 |
| 5,329,890 | 7/1994 | Muller | 123/90.31 |

FOREIGN PATENT DOCUMENTS

| | | | |
|---|---|---|---|
| 3929623 | 3/1991 | Germany | 123/90.17 |
| 91/03628 | 3/1991 | WIPO | 123/90.17 |

*Primary Examiner*—Henry C. Yuen
*Assistant Examiner*—Weilun Lo
*Attorney, Agent, or Firm*—Michael J. Striker

[57] ABSTRACT

The device for the relative rotation of the shaft of an internal combustion engine with respect to the drive wheel, which is rotatably arranged on the shaft, has a hydrostatic pump whose housing is torsionally securely connected to the camshaft. Within the drive wheel and the pump, there is an electromagnetically actuable control valve which controls the pressure medium connections between the pumps and the setting device (rotary piston control), i.e. it subject the pressure spaces to pressure or relieves them, so that the camshaft is correspondingly rotated relative to the drive wheel. The electromagnet of the control valve is actuated by means of a control unit influenced by sensors. The pressure medium supply to the setting device takes place via a hole in the camshaft. A very compact adjusting device for the camshaft is achieved in this way.

24 Claims, 7 Drawing Sheets

Ia
Ib
IIa
IIb
90°
180°
270°
360°
0
V
13
72
II
I
17
25A-27A
25B-27B

360°
180°
0
Ic
IIc
I
II
13
72
25A-27A
25B-27B

IVa
IIIa
360°
180°
0
V
15'
13'
72
II
I
a
b
c
d
71
25A-27A
25B-27B

IVc
IVb
IIIc
IIIb
270°
180°
90°
45°
0
V
13'
72
II
I
a
b
c
d

METHOD FOR ACTIVATING A DEVICE FOR THE RELATIVE ROTATION OF A SHAFT AND DEVICE FOR THE RELATIVE ROTATION OF THE SHAFT OF AN INTERNAL COMBUSTION ENGINE

BACKGROUND OF THE INVENTION

The invention is based on a method for activating a device for the relative rotation of a shaft and on a device for the relative rotation of the camshaft of an internal combustion engine relative to the drive wheel of the camshaft rotatably arranged on the same. In known devices and methods of this type for the activation, a piston/cylinder device is acted upon by means of a control valve, and the piston displaces a coupling element which is supported in a recess of the camshaft. On the coupling element, which is in engagement with the camshaft, there are straight and helical teeth which, when the setting piston is displaced, rotate the camshaft relative to the drive wheel. A hydrostatic pump driven by the camshaft supplies the pressure medium necessary for the adjustment of the setting piston. The setting piston is subjected to pressure at both ends, one end being continually subjected to the pressure generated by the pump. The pressure on the other end of the piston is varied, as a function of certain control parameters, by the control valve by pressure reduction or by permitting pressure medium to flow away (de-activation). A method of this type and a device of this type are very complex and also, therefore, complicated and, more particularly, require a high expenditure of energy.

SUMMARY OF THE INVENTION

The method according to the invention for activating a device for the relative rotation of a shaft in accordance with which the control valve connects the pump, as a function of its working phase (suction phase/pressure phase), with respectively one of the pressure spaces of the setting element, has, in contrast, the advantage that a very rapid and energy-favourable mode of operation is possible. A device for the relative rotation of the shaft of an internal combustion engine, characterized in that the setting element is located within the drive wheel of the shaft and is configured as a rotary piston actuator whose hub is arranged so that it is fixed on and rotates with the central housing located in the middle of the control valve, and in the rotor of the hydraulic pump is arranged on the same axis as the rotary piston actuator and is driven by the camshaft, can be operated in a particularly advantageous manner with a method of this type.

The device according to the invention for the relative rotation of the camshaft of an internal combustion engine, has the advantage that it is configured in a simple manner and is also particularly compact in construction. It is, more particularly, characterized by a very low energy requirement. The oil loss is limited to leakage losses because the oil quantities to be displaced from the setting gear are re-induced by the pump. In a preferred embodiment of the invention, the adjusting element is hydraulically locked in the rest position by means of the control valve; there is no forced control deviation. The energy consumption in this embodiment is particularly low because energy consumption only takes place during the adjustment.

In another preferred embodiment, the complete pump revolution is used in an advantageous manner for the delivery and adjustment, independent of the pump working space (individual pump) which is currently delivering. The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

The drawings show a longitudinal section through a camshaft adjusting device in FIG. 1, a section along II—II of FIG. 1 in FIG. 2, a section along III—III of FIG. 1 in FIG. 3 and working diagrams of the pumps and associated valve activation systems used in the device in FIGS. 4 to 7 (*a* to *e* in each case).

DESCRIPTION OF THE PREFERRED EXAMPLES

Figure 1:
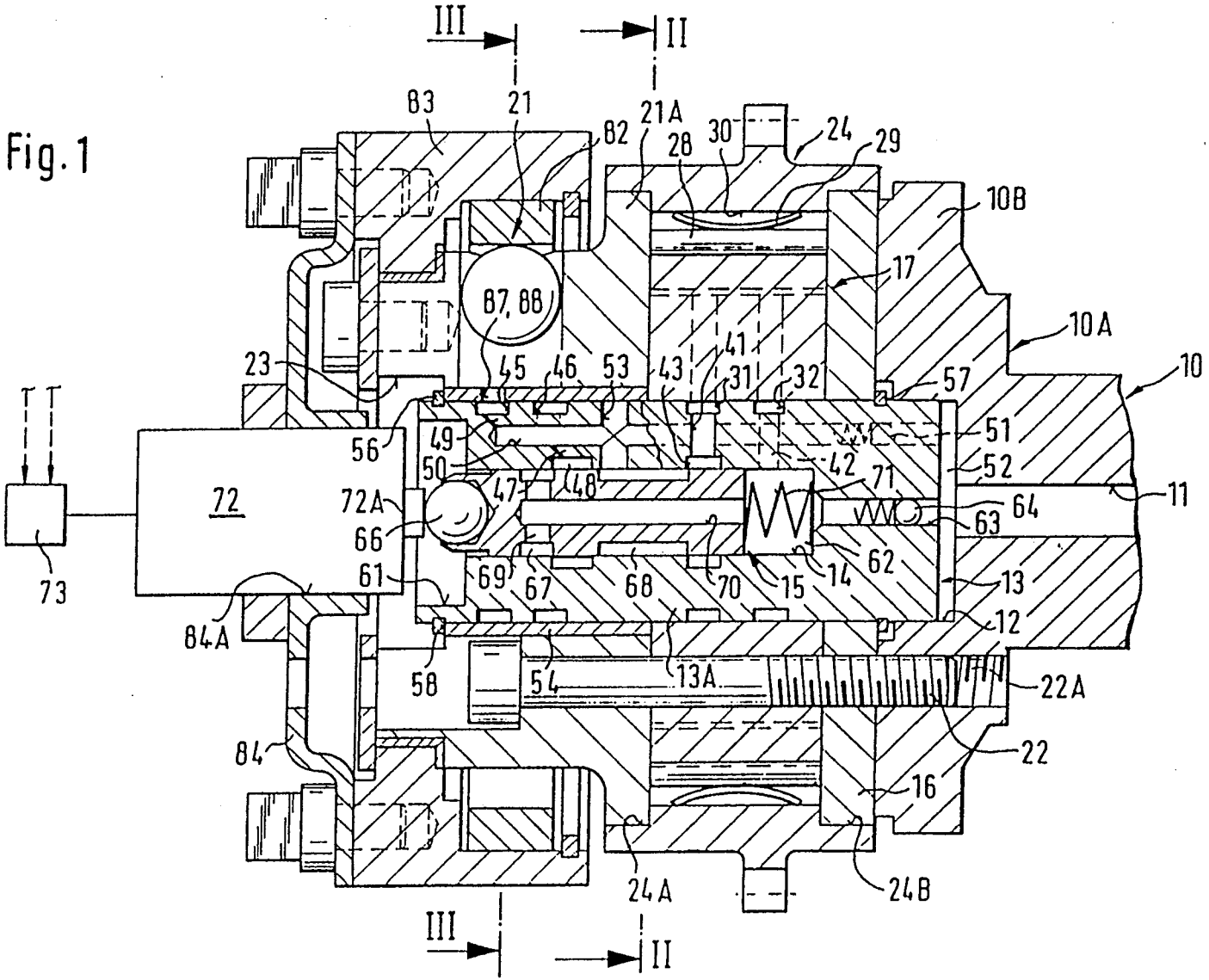

In the drawing, the end part of the camshaft 10 of an internal combustion engine is designated by 10A. At the end surface, there is an outwardly directed flange 10B with a cylindrical depression 12 into which opens a longitudinal hole 11 which penetrates the camshaft 10. The longitudinal hole 11 is connected to the pressurized oil supply of the internal combustion engine of a motor vehicle. A cylindrical valve housing 13A of a control valve 13, in which is formed a spool-valve bore 14 which in turn accommodates a control spool 15, is inserted into the depression 12. The further design of the valve is considered later.

Connected to the camshaft 10 and the flange 10B and seated on the valve housing 13A, there is a disc 16, an impeller configured as a rotary piston actuator 17 with the vanes 18, 19, 20 (see FIG. 2) and a hollow cylindrical pump housing 21A of a pump 21. The diameter of the disc 16 corresponds approximately to that of the flange 10B whereas that of the rotary piston actuator 17 is smaller. The end surface, facing towards the rotary piston actuator 17, of the pump housing 21A is extended outwards like a flange and its diameter corresponds approximately to that of the disc 16. The pump housing 21A, the rotary piston actuator 17 and the disc 16 are rotationally securely clamped together by four bolts 22 and are connected to the flange 10B of the camshaft 10. These bolts 22 and the associated holes 22A start from a cylindrical depression 23 formed in the end surface, facing away from the rotary piston actuator 17, of the pump housing 21A. The holes 22A extend into the flange 10B of the camshaft 10.

The rotary piston actuator 17 is surrounded by a drive wheel 24 configured as a gearwheel. On its end surfaces, this gearwheel 24 has respective cylindrical counterbores 24A and 24B for accommodating the flange-type end surface of the pump housing 21A and the disc 16. The drive wheel 24 drives, in a manner still to be explained, the camshaft 10 and the pump housing 21A (rotor of the pump 21).

Figure 2:
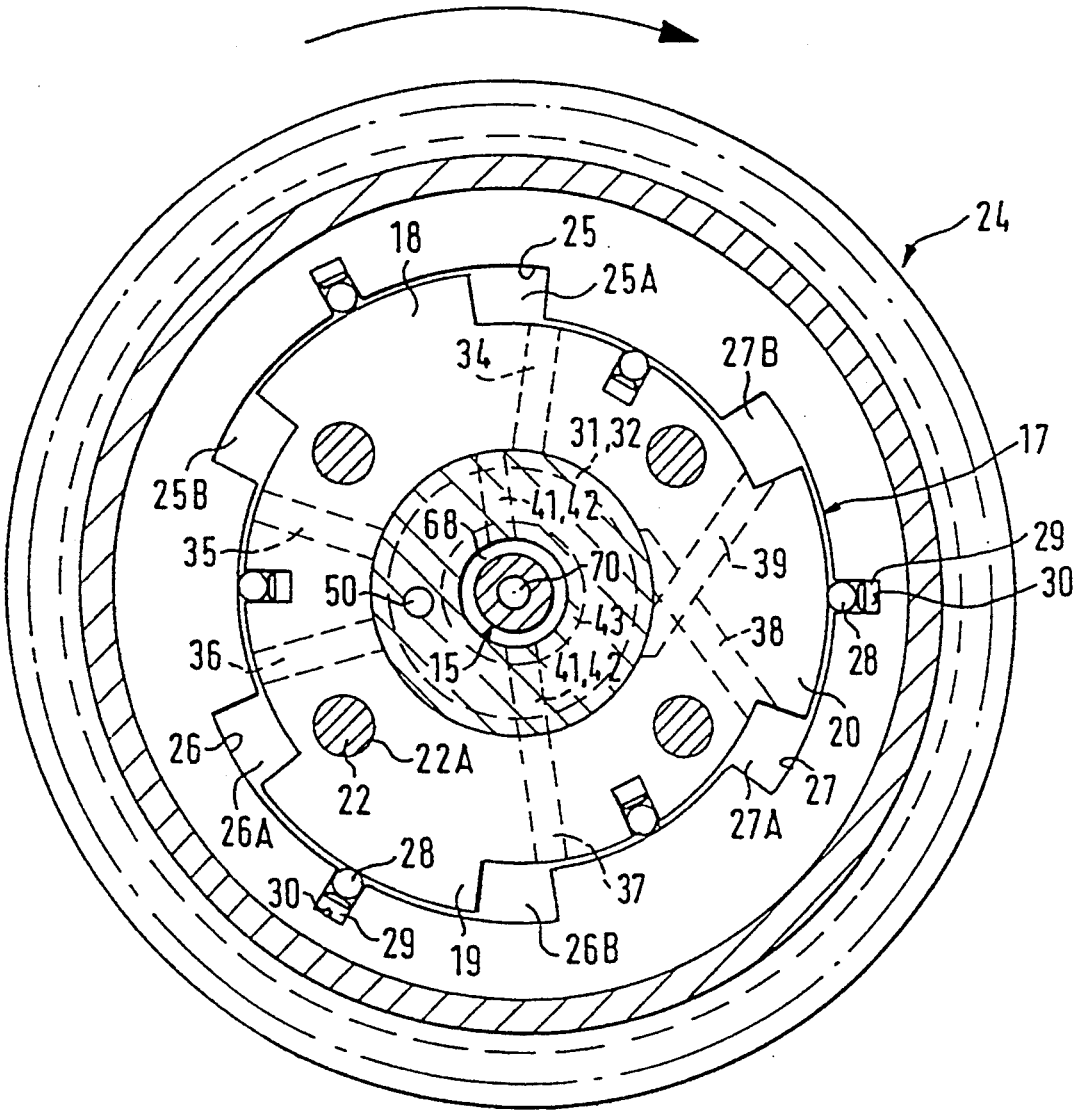

The vanes 18 to 20 of the rotary piston actuator 17 (impeller) are located in corresponding recesses 25 to 27—visible in FIG. 2—of the drive wheel 24 and can be rotated there by an angle of approximately 25° relative to the drive wheel 24. Sealing rollers 28, which are pressed by leaf springs 29 onto the outer surface of the vanes and onto the inside of the drive wheel 24, are used for sealing the vanes 18 to 20 against the recesses 25 to 27. These sealing rollers 28 and leaf springs 29 are located in axial grooves 30 which are respectively formed in the rotary piston actuator 17 and in the drive wheel 24. The axial grooves 30 are respectively arranged approximately in the centre between two vanes 18 to 20 in the rotary piston actuator 17 and in the centre of a recess 25 to 27. Pressure spaces 25A to 27A and 25B to 27B are bounded between the sealing rollers 28 arranged in the vanes 18 to 20 of the rotary piston actuator 17 and the sealing rollers 28 arranged in the recesses 25 to 27 of the drive wheel 24. In the direction selected for the representation in FIG. 2 and considered in the clockwise direction, the pressure spaces 25A to 27A are located behind the sealing rollers 28 in the corresponding recess 25 to 27 and the pressure spaces 25B to 27B in front.

The rotary piston actuator 17 is penetrated by several holes 34 to 39 which, on the one hand, are respectively connected to one of the pressure spaces 25A to 27A and 25B to 27B and, on the other hand, are connected to annular grooves 31, 32 at the outer periphery of the cylindrical valve housing 13A. The holes 34, 36 and 38 respectively open into the annular groove 31—the left-hand one in FIG. 1—and the holes 35, 37 and 39 open correspondingly into the right-hand annular groove 32. Depending on the position of the spool 15 of the control valve 13, the pressure spaces 25A to 27A and 25B to 27B are subjected to pressure or relieved via these holes so that the rotary piston actuator 17 carries out a rotational motion either in the clockwise direction or in the anti-clockwise direction. By this means, the camshaft 10 is set to an "advanced" setting or to a "retarded" setting of the valves of the internal combustion engine, i.e. there is a "phase" shift of the camshaft relative to the drive wheel 24 and to the crankshaft.

Two radial holes 41 and 42, which start from the annular grooves 31 and 32, penetrate the cylindrical valve housing 13A of the control valve 13. The radial hole 42 starts from the annular groove 32 and opens into the spool-valve bore 14, whereas the radial hole 41 starts from the annular groove 31 and opens into an annular control groove 43 surrounding the spool-valve bore 14. Two further annular grooves 45, 46 are formed in the outer periphery of the valve housing 13A in the region of the pump housing 21A. A radial hole 47 starts from the annular groove 46—the right-hand one in FIG. 1—and this radial hole 47 penetrates into a second annular control groove 48 on the spool-valve bore 14. An oblique hole 49 starts from the (left-hand) annular groove 45 and penetrates into a pocket hole 50 which extends, in turn, parallel to the spool-valve bore 14 and starts from the right-hand end of the valve housing 13A and from the depression 12. A non-return valve 51, which can open in the case of a pressure medium flow in the direction from a chamber 52 towards the oblique hole 49, is constructed in this pocket hole 50. This chamber 52 is formed between the valve housing 13A and the bottom of the depression 12. The pocket hole 50 is penetrated by a radial hole 53 which likewise opens at the spool-valve bore 14 and which is covered at the outer periphery of the valve housing 13A by a sleeve 54. This sleeve 54 is arranged in the region of the hollow cylindrical pump housing 21A between the latter and the valve housing 13A and is securely connected to the pump housing 21A.

The valve housing 13A is torsionally securely connected to the rotary piston actuator 17, for example by means of a press fit. The sleeve 54, and the pump housing 21A securely connected to it, are fixed in the axial direction by means of a lock ring 56, which is applied at the outer periphery of the valve housing 13A and is inserted in an annular groove 58. The sleeve 54 is therefore located at one of its end surfaces on the rotary piston actuator 17 and by its other end surface on the lock ring 56. A further lock ring 57, which is in contact with the disc 16 and secures the latter and the rotary piston actuator 17 against displacement before attachment to the camshaft 10, is fitted at the outer periphery of the valve housing 13A in the region of the flange 10B of the camshaft 10.

A cylindrical counterbore 61, from which the spool-valve bore 14 starts, is formed in the end surface of the valve housing 13A in the region of the depression 23 in the pump housing 21A. An axial hole 63, which opens into the chamber 52, starts from the bottom 62 of the spool-valve bore 14. A non-return valve 64, which can open in the case of a pressure medium flow from the chamber 52 to the spool-valve bore 14, is arranged in this axial hole 63.

The spool 15 is guided in the spool-valve bore 14 so that it slides in a sealed manner. With one of its end surfaces, the spool 15 protrudes into the depression 61 and is there provided with an actuation ball 66. Two annular control grooves 67 and 68 are formed in outer periphery of the spool 15. The annular control groove 67—the left-hand one in FIG. 1—is connected to a hole 69 which radially penetrates the spool 15 and into which an axially extending pocket hole 17 opens, which latter starts from the end surface of the spool 15 located in the spool-valve bore 14. One end of a compression spring 71 is supported on this end surface and its other end is in contact with the bottom 62 of the spool-valve bore 14. At the opposite end surface of the control valve 13, the tappet 72A of an electromagnet 72, by means of which the spool 15 is adjusted against the action of the compression spring 71, is in contact with the guide ball 66. This electromagnet 72 is activated on the same axis as the camshaft 10 and is arranged so that it is torsionally fixed. It is activated by a control unit 73.

Figure 3:
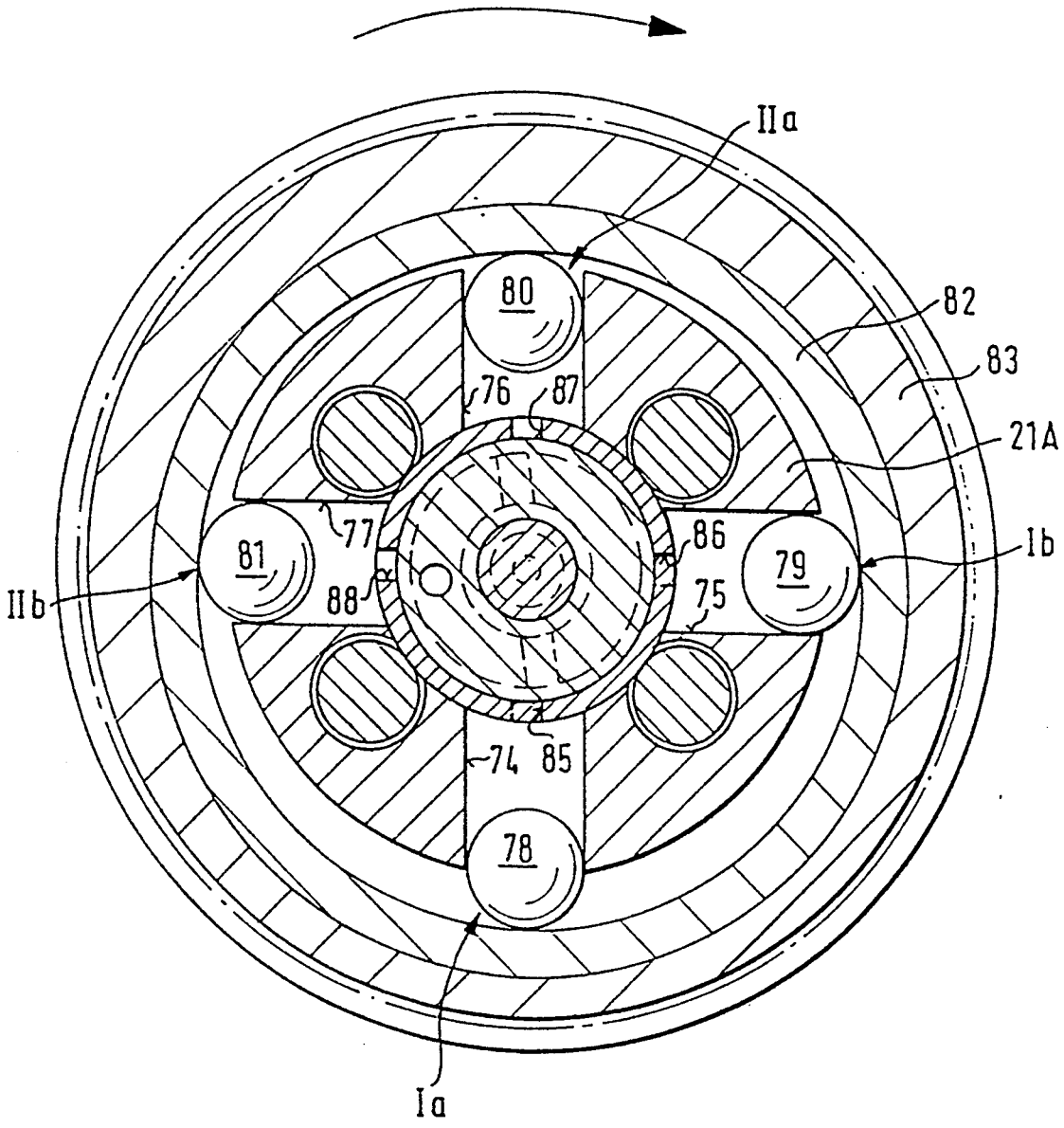

As is shown in particular in FIG. 3, four radially extending through bores 74 to 77 are formed in the pump housing 21A; these are respectively offset by 90° relative to one another and a ball piston 78 to 81 is guided in each of them. At the outside, these ball pistons are in contact with a cam ring 82, which is arranged in a pump cover 83 closing the pump housing 21, and whose cam curve is circular and extends eccentrically relative to the longitudinal axis of the camshaft 10. The pump cover 83, and with it the cam ring 82, are stationary whereas the pump housing 21A, with the camshaft 10, rotates—as already mentioned at the beginning. For this purpose, the pump cover 83 is connected in an appropriate manner to the surroundings or to the installation space. A simple claw coupling can, for example, be used for this purpose. The drive torque which builds up in operation can then, for example, be supported on the engine front cover of the internal combustion engine. A closing cover 84 is fastened to the free end surface of the pump cover 83 and the electromagnet 72 protrudes through the central opening 84A of this closing cover.

The pump described is a double pump, i.e. two mutually adjacent pistons located offset by 90° relative to one another but with their axes in the same plane, together with their corresponding bores, form the two pump elements. It is, however, also possible to provide only one pump with two mutually opposite pistons.

In the embodiment example, the sleeve 54 is penetrated by four pressure medium openings, of which the two pressure medium openings 87 and 88 may be recognized in FIGS. 1 and 3. The two pressure medium openings 85 and 86 are offset in the axial direction relative to the pressure medium openings 87 and 88 and are represented diagrammatically in FIG. 3. These pressure medium openings 85 to 88 act as the inlet and outlet openings of the (pump) bores 74 to 77. The pressure medium openings 85 and 86 connect the bores 74 and 75 to the (right-hand) annular groove 46 and the pressure medium openings 87 and 88 connect the two other bores 76 and 77 to the (left-hand) annular groove 45 of the control valve 13.

In its switching position shown in FIG. 1, the electromagnet 72 has current flowing through it, i.e. the tappet 72A sets the spool 15 against the action of the compression spring 71 from its (left-hand) neutral position I into its (right-hand) switching position II. In this switching position II of the spool 15, the annular control groove 67 in the control spool 15 and the second annular control groove 48 on the spool-valve bore 14 are connected together. Furthermore, the annular control groove 68 of the control spool 15 and the annular control groove 43 of the spool-valve bore 14 are also connected together. The bores 76 and 77 in the pump housing 21A are connected to the annular groove 45 via the pressure medium openings 87 and 88 and are connected to the pocket hole 50 via the hole 49. There is a connection from this pocket hole 50 to the spool-valve bore 14 in the region of the annular control groove 68 via the radial hole 53. From the annular control groove 68, pressure medium can reach the annular groove 31 via the annular control groove 43 and the radial hole 41 and, from the annular groove 31, it can reach the pressure spaces 25A, 26A and 27A via the holes 34, 36 and 38. The other pressure spaces 25B, 26B and 27B are connected to the annular groove 32 by means of the holes 35, 37 and 39. From the annular groove 32, the radial hole 42 leads into the spool-valve bore 14 in the region between the bottom 62 and the end of the control spool 15. Pressure medium can reach the annular control groove 67 via the pocket hole 70 in the control spool and via the hole 69. The annular control groove 67 is—as already described—connected to the second annular control groove 48. From the latter, there is a connection via the radial hole 47 and the annular groove 46 to the pressure medium openings 85 and 86 and, therefore, to the bores 74 and 75.

When the electromagnet 72 is not excited, the spool 15 is moved by the action of the compression spring 71 into its (left-hand) neutral position. In this neutral position, the annular control groove 43 is closed at one end by the control spool 15. Simultaneously, the annular groove 67 of the control spool 15 is also closed by the wall of the spool-valve bore 14. The pressure spaces 25A to 27A and 25B to 27B are therefore likewise closed at one end. In addition, the second annular control groove 48 on the spool-valve bore 14 and the annular control groove 68 of the control spool 15 are connected together. The two bores 74 and 75 in the pump housing 21A and the bores 76 and 77 are therefore respectively connected to one another and all four bores 74 to 77 are short-circuited via the two annular control grooves 48 and 68.

If the camshaft is driven during operation of the device for relative rotation of the camshaft, the pump housing 21A, with the bores 74 to 77 arranged in it and the corresponding ball pistons 78 to 81, rotates with the camshaft. The ball pistons 78 to 81 are supported on the cam ring 82 fitted in the stationary pump cover 83 so that these ball pistons execute an upwards and downwards motion (suction stroke and compression stroke). During a suction stroke of the ball pistons 80 and 81 (radially outwards motion) and when the control valve 13 and the control spool 15 are in the switching position II, the bores 76 and 77 can be supplied with pressure medium from the chamber 52 via the non-return valve 51, which opens, via the longitudinal hole 11 in the camshaft 10. During a compression stroke of the ball pistons 78 and 79, this non-return valve 51 closes. The two other bores 74 and 75 can be correspondingly filled with pressure medium via the non-return valve 64, which opens during the suction stroke (when the control spool 15 and the control valve 13 are in the switching position II). If the control valve 13 (control spool 15) is in its neutral position I, the four bores 74 to 77 are short-circuited—as already stated. Only essentially unpressurized pumping of the pressure medium back and forth between these four bores then takes place. Pressure medium losses due to leakage losses can, however, be made good via the non-return valve 51 even in this neutral position I of the control spool 15.

In order to rotate the rotary piston actuator 17 and the drive wheel 24 relative to one another, the electromagnet 72 is activated so that an adjustment of the control valve 13 into the switching position II of the control spool 15 takes place—as is explained in FIGS. 4*a* to 4*e*.

Figures 4A, 4B, 4C, 4D, 4E:
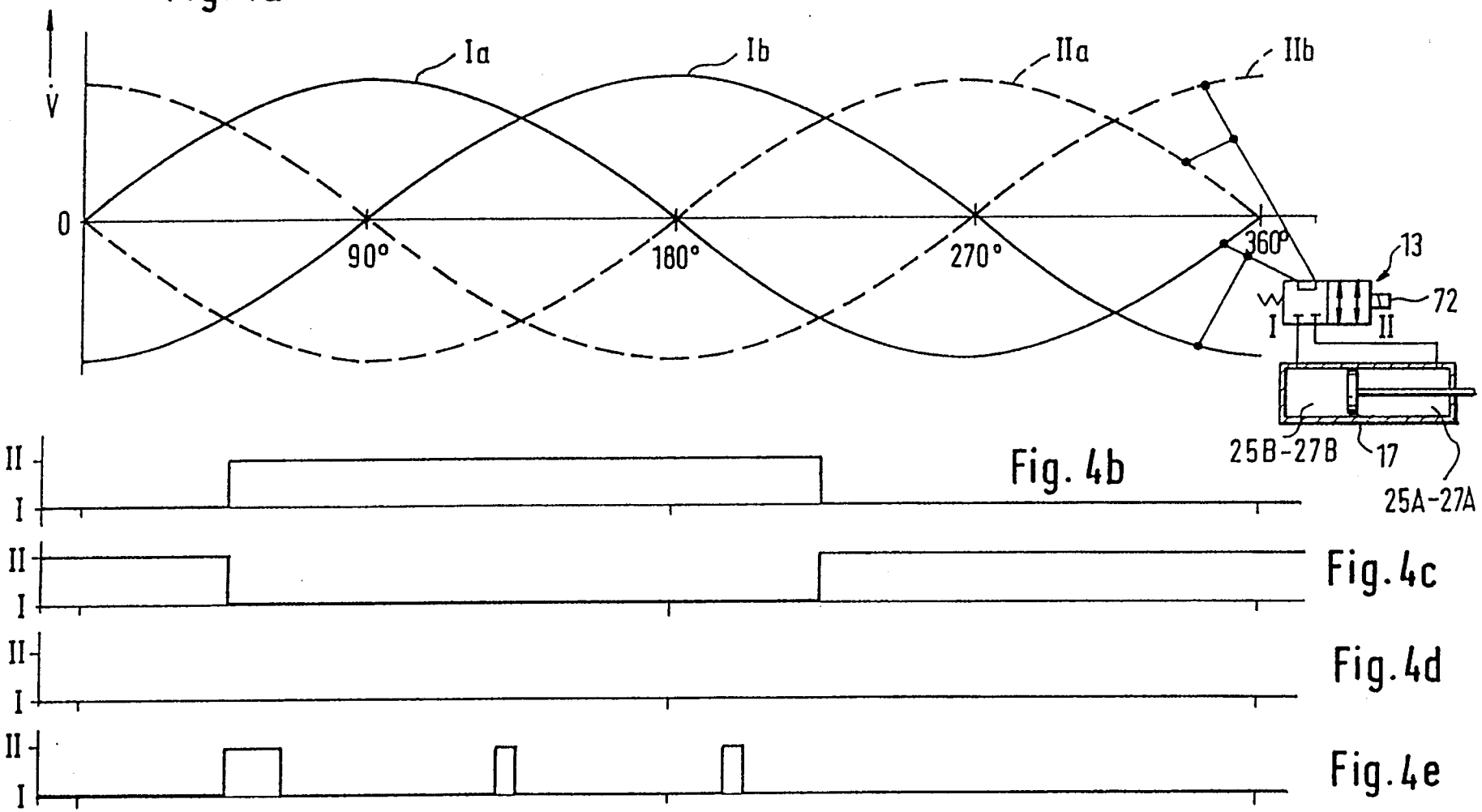

FIG. 4*a* shows the delivery flow curve of the four individual pumps I*a*, I*b*, II*a*, II*b*, which are formed by the bores 74 to 77, together with the ball pistons 78 to 81. The two individual pumps I*a* and I*b* are formed by the bores 74 and 75, together with the ball pistons 78 and 79; they are continually connected together and act on the pressure spaces 25B to 27B. The two individual pumps II*a* and II*b*, which are likewise continuously connected together, are correspondingly formed by the two other bores 76 and 77, together with the ball pistons 80 and 81, and act on the pressure spaces 25A to 27A.

The delivery flow curve is shown over a revolution (360° ) of the pump housing 21A and begins at zero throughput of the volume flow of the individual pump Ia, i.e. at the top dead centre of the ball piston 78. The three other individual pumps I*b*, II*a* and II*b* are respectively phase-shifted by 90°, i.e. in accordance with the direction of rotation shown in FIG. 3, the individual pump I*b* executes a suction stroke, the individual pump II*a* is at the bottom dead centre and the individual pump IIb executes a compression stroke.

In order to bring the camshaft 10 into an "advanced" rotational position, i.e. in order to achieve an advanced valve actuation, the rotary piston actuator 17 must be rotated in the rotational direction (in the clockwise rotational direction in this case) relative to the drive wheel 24. For this purpose, the pressure in the pressure spaces 25B to 27B must be greater than that in the pressure spaces 25A to 27A. In the case of equal pressure surfaces, the relative rotation of the rotary piston actuator 17 then occurs. For this purpose, the control valve 13 (shown diagrammatically as a 4/2-way valve in FIG. 4*a*) is displaced, by means of the electromagnet 72, for a defined interval from its neutral position I into its switching position II if, starting with balanced pressure relationships in the pressure spaces 25A to 27A and 25B to 27B, the delivery volume of the two individual pumps I*a* and I*b* is positive in sum (pressure phase) and that of the two individual pumps IIa and IIb is negative (suction phase). This delivery condition is achieved, in the example of the delivery flow curve represented in FIG. 4*a*, in the range of rotational angle between 45° and 225°.

The corresponding activation of the electromagnet 13 is shown in FIG. 4*b*. This electromagnet 13 is activated, i.e. current is supplied to it, for an adjustment of the camshaft into an "advanced" rotational position when the sum of the volume flows of the individual pumps I*a* and I*b* is positive, i.e. when the volume flow expelled exceeds the induced volume flow. This activation therefore begins at a rotational angle of the individual pump I*a* of 45°. In this phase, the expelled volume of the individual pump I*a* is equal to the induced volume of the individual pump I*b*. The suction volume of the individual pump II*a* and the pressure volume of the individual pump II*b* likewise complement one another to zero in this rotational phase. The activation of the electromagnet 72 via the control unit 73 is maintained over the pressure phase of the two individual pumps I*a* and I*b* (from the rotational angle 90° to the rotational angle 180° of the individual pump I*a*) and continues until such time as the sum of the volume flows becomes negative. This negative volume flow sum begins at an angle of rotation of the individual pump I*a* of 225°. After this rotational angle, the induced volume of the individual pump I*a* is greater than the expelled volume of the individual pump I*b*. The volume flow sum of the individual pumps II*a* and II*b* is negative over the whole of this rotational range (45° to 225°).

Due to the activation of the electromagnet 72, the control valve 13 is brought into its switching position II so that the pressure spaces 25B to 27B are subjected to the volume flow sum of the individual pumps I*a* and I*b*. The pressure spaces 25A to 27A are simultaneously connected to the individual pumps II*a* and II*b*. The volume flow sum of the latter, however, is negative, i.e. pressure medium is induced. The rotary piston actuator 17 is therefore rotated in the clockwise direction relative to the drive wheel 24, i.e. in the "advanced" rotational position direction of the camshaft 10.

In order to adjust the camshaft 10 into a "retarded" rotational position, the pressure spaces 25A to 27A are correspondingly subjected to pressure. For this purpose, the electromagnet 72 is activated by the control unit 73—as shown in FIG. 4*c*—when the volume flow sum of the two individual pumps II*a* and II*b* is greater than that of the individual pumps I*a* and I*b*. This is the case at an angle of rotation of the individual pump Ia between 225° and 405° or 45°.

In order to keep the camshaft 10 in a rotational position which has been set—even if this is not an end position of the rotary piston actuator 17—the current to the electromagnet 72 is switched off so that the control valve 13 is brought into its neutral position I (FIG. 4*d*). In this neutral position I, the pressure spaces 25A to 27A and 25B to 27B are closed at one end, i.e. the rotary piston actuator 17 is hydraulically locked.

The activation of the electromagnet 72 takes place by means of the control unit 73. The latter records the actual phase position of the camshaft 10 by means of angular sensors (not shown), compares this actual phase position with a specifiable required value and, while taking account of the instantaneous pump position, generates a cyclically associated pulse signal. This signal and this activation can take place, as a function of the desired adjustment of the camshaft, in a plurality of sequentially arranged pulses in the respectively associated angular range. In the case of relatively small adjustment ranges or correction ranges, it is also possible to generate this signal or this activation over only a partial range of the maximum possible angular range.

The adjustment of the camshaft 10 in the "retarded" angular position direction is supported, in the operating condition, by a reaction torque which is the result of the cam actuation. The adjustment of the camshaft into the "retarded" angular position direction can also take place exclusively on the basis of this reaction torque. Because of the effect of this reaction torque, small leakage losses of the rotary piston actuator occur in the operating condition so that the rotary piston actuator 17 is correspondingly rotated. In order to compensate for these leakage losses when no adjustment is desired, the electromagnet 72 is generally activated by short switching signals in the advanced adjustment phase (angular range between 45° and 225° of the individual pump I*a*)—as shown, as an example, in FIG. 4*e*. A follow-up motion of the rotary piston actuator 17 therefore takes place.

Further individual pump arrangements and corresponding activations of the control valve are possible in addition to the embodiment example described, the basic principle of the cyclic association between the individual pumps and the pressure spaces 25A to 27A and 25B to 27B being retained in each case. Various arrangements with fixed association between the individual pumps and the pressure spaces 25A to 27A and 25B to 27B are possible here. In this case, each individual pump can act only on the pressure spaces 25A to 27A or 25B to 27B acting in one adjustment direction. The control valve is then—as previously described in the embodiment example—configured in such a way that the pressure spaces are closed at one end in the neutral position I of the control valve. The rotary piston actuator is therefore—as previously described hydraulically locked, with the exception of the effects of possible leakage losses.

a) In the simplest case, two opposite individual pumps with one (ball) piston each are used, each individual pump being permanently associated with the pressure spaces 25A to 27A and 25B to 27B acting in one adjustment direction. Reference is here made to the diagrammatic representation of the volume flows and the activation of the electromagnet 72 and of the control valve 13 of FIG. 5 (5*a* to 5*e*, analogous to FIG. 4*a* to 4*e*). The control valve 13—represented as a 4/2-way valve in this figure—closes both individual pumps I*c* and II*c* briefly in the neutral position I (no current is supplied to the electromagnet 72) and simultaneously shuts off the pressure spaces, for example 25A to 27A and 25B to 27B. In the switching position II of the control valve 13, the so-called "advance pump" (individual pump I*c*) is connected to those pressure spaces which effect the advanced adjustment of the camshaft 10 when subjected to positive pressure (for example pressure spaces 25B to 27B) and the so-called "retard pump" (individual pump II*c*) is connected to the pressure spaces which effect the retarded adjustment when subjected to positive pressure (for example the pressure spaces 25A to 27A).

Figures 5A, 5B, 5C, 5D, 5E:
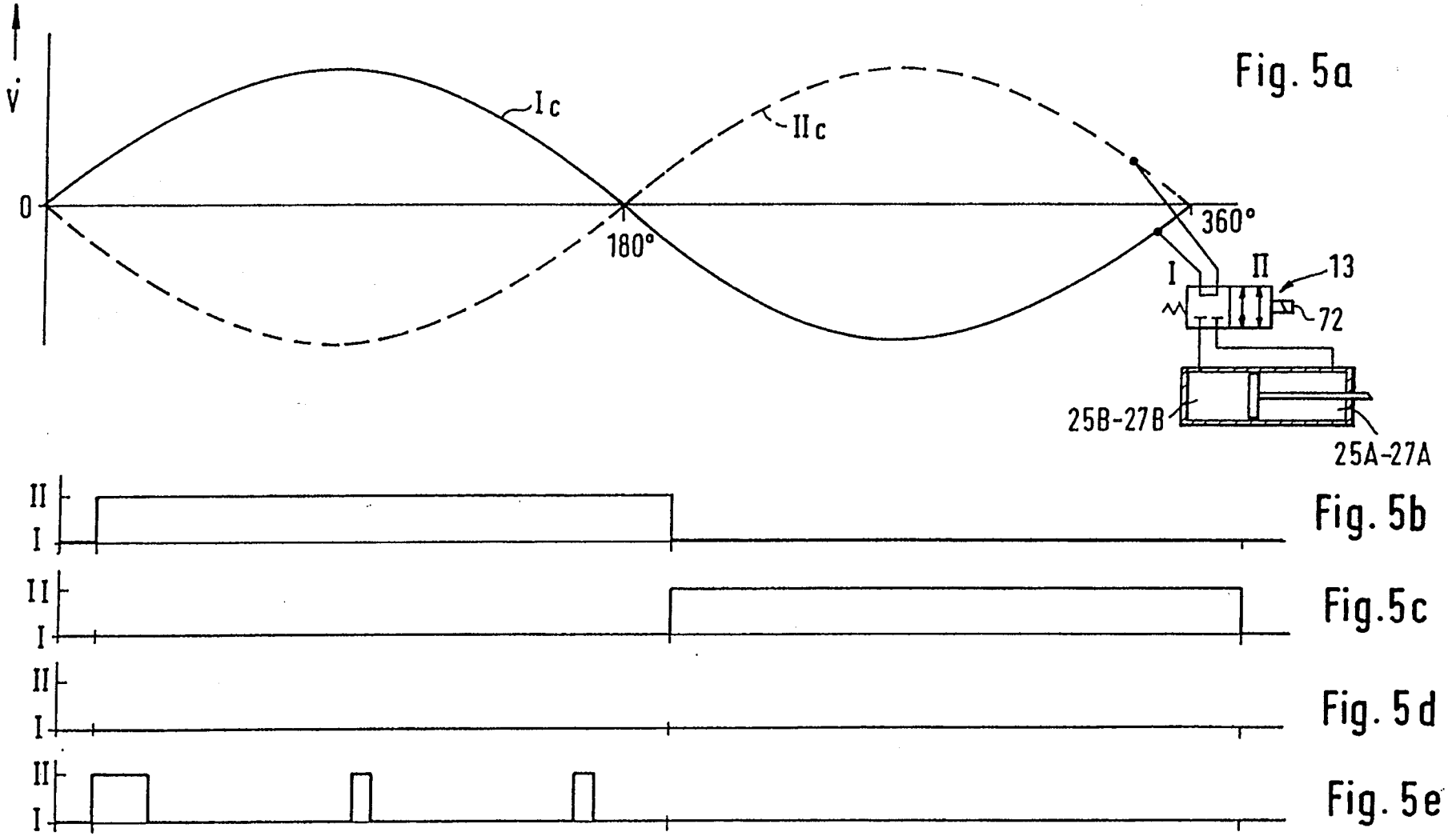

The volume flow curves of the two individual pumps I*c* and II*c* are shown in FIG. 5*a*, the full line showing the volume flow curve of the individual pump I*c* ("advance pump") and the interrupted line showing the volume flow curve of the individual pump II*c* ("retard pump"). The activation of the electromagnet 72 and therefore of the control valve 13 is given in the four switching positions underneath. The first activation of the electromagnet shown in FIG. 5*b* signifies advanced adjustment and the second activation shown in FIG. 5*c* leads to a retarded adjustment (without leakage). For advanced adjustment, the corresponding pressure spaces (for example 25B to 27B) are activated in the pressure phase of the individual pump I*c* (0° to 180°) and the other pressure spaces (for example 25A to 27A) are therefore simultaneously connected to the individual pump II*c* during the suction phase. When adjustment is desired, the electromagnet 72 must be activated, depending on the adjustment direction, at the times given in the diagram, i.e. the advanced adjustment takes place for an activation in the angular range between 0° and 180° of the individual pump I*c* and a retarded adjustment takes place for an activation in the range between 180° and 360°. The angular range is in this case fixed in such a way that the angle 0° corresponds to the top dead centre of the individual pump I*c*.

This angle therefore corresponds to the beginning of the pressure phase of this individual pump I*c*. When the electromagnet 72 is not excited (neutral position I of the control valve 13, FIG. 5*d*), no adjustment takes place, the pumps are short-circuited and fill one another without taking power (with the exception of friction and leakage losses).

In order to compensate for leakage losses in the setting gear and the oil supply, the electromagnet 72 (control valve 13) is activated with short control pulses in that phase which acts against the control deviation (generally in the advanced adjustment phase). The follow-up for the leakage quantities occurring takes place by means of the two non-return valves 51, 64 of the engine oil circuit (FIG. 5*e*).

b) In the case of a configuration of the pump with four individual pumps, the stroke generation can also take place by means of an elliptical cam ring which generates per revolution, at each piston, a double stroke of each individual pump. The individual pumps respectively arranged offset by 180° relative to one another are in this case, however, combined. Two individual pumps respectively arranged offset by 180° then act as the "advance pump" and the two other individual pumps act as the "retard pump". The activation takes place by analogy with the circuit diagram explained in FIGS. 5*a* to 5*e*.

c) In the case of a configuration of the pump in accordance with the principle described under a), it is also possible to arrange four pistons sequentially (in the axial direction) in pairs and offset by 180° relative to one another. These are driven by likewise sequentially arranged circular cam rings arranged eccentrically with their eccentricity offset by 180° (two-row pump). The individual pumps of each pump row respectively offset by 180° are in this case combined so that they operate in phase and act on the same pressure spaces. The activation likewise takes place by analogy to the circuit diagram described in FIGS. 5*a* to 5*e*.

An advantage in principle of the previously described devices for the relative rotation of the camshaft of an internal combustion engine is the very low energy requirement when compared with other hydraulic solutions which operate on the de-activation principle. Energy is consumed only during the adjustment in this case. A marked noise advantage may be expected, particularly compared with a device for the relative rotation of the camshaft by a suction-throttled pump, because the pistons or ball pistons are in continuous contact with the cam. The oil consumption or the oil losses in such a device are limited to leakage losses because the oil quantities to be displaced from the rotary piston actuator are re-induced by the individual pumps. The rotary piston actuator is hydraulically locked in the rest position (in the case of the non-activated electromagnet, neutral position I of the control valve) and no control deviation is "forced". The embodiment of the pump 21 with two individual pumps I*c* and II*c*, as described under a), provides a very simple construction of the pump because of the two diametrically opposite cylinder bores. The pump 21 shown in FIGS. 1 to 3 has, in contrast, a delivery volume which is increased by a factor of the square root of 2 for the same dimensioning of the individual pumps and for a simple contour of the cam ring. The configuration of the pump with four individual pumps and an elliptical cam ring, as described under b), provides a delivery volume which is increased by a factor of 4 and provides a camshaft end free from transverse forces because of the balancing of the simultaneously acting diametral pump forces. As compared with the configuration described under a), the configuration described under c) has a delivery volume increased by a factor of 2 and likewise has a camshaft end which is free from transverse forces.

In contrast to the previously described embodiment examples, it is also possible to associate the respective individual pumps to the pressure spaces without permanent mutual relationship. The phase-dependent and direction-dependent association necessary for a defined adjustment takes place by means of the control valve 13'. The control valve 13' is likewise configured as a 4/2-way valve and its control spool 15' can be switched by the electromagnet 72 from its neutral position I into the switching position II against the action of the compression spring 71. The control spool 15' is configured in such a way that of the four connections a–d, the connections a and d and the connections b and c are respectively connected in the neutral position I. In the switching position II, on the other hand, the connections a and c and the connections b and d are connected together. The connection c is connected to the pressure spaces (for example 25B to 27B) of the rotary piston actuator 17 and these pressure spaces effect an advanced adjustment of the camshaft when they are subjected to positive pressure. The connection d is connected to the other pressure spaces (for example 25A to 27A) of the rotary piston actuator and these pressure spaces effect a retarded adjustment of the camshaft when they are subjected to positive pressure. In the volume flow curve shown in FIG. 6*a*, the pump is composed of two individual pumps III*a* and IV*a*. These individual pumps III*a* and IV*a* are arranged offset by 180° and interact with an eccentric circular cam ring. The individual pump III*a* is in this case connected to the connection a of the control valve 13A whereas the individual pump IV*a* is connected to the connection b of the control valve 13A.

For advanced adjustment of the camshaft (FIG. 6*b*), the electromagnet 72 is activated in the pressure phase of the individual pump III*a* (0° to 180°). In this phase, the other individual pump IV*a* is in its suction phase. The control valve 13' is brought into its switching position II by the activation of the electromagnet 72. In this switching position II, the individual pump III*a* is connected via the connection a of the control valve 13' to the connection c of the latter and therefore to the pressure spaces which have to be subjected to pressure for an advanced adjustment (for example 25B to 27B). The individual pump IV*a* is simultaneously connected via the connections b and d of the control valve 13' to the other pressure spaces (25A to 27A). The current is switched off from the electromagnet 72 in the angular range between 180° and 360°—in the suction phase of the individual pump III*a*. In consequence, the control spool 15' of the control valve 13' moves into its neutral position I so that the pressure spaces which have to be subjected to pressure for an advanced adjustment (for example 25B to 27B) are acted upon by the individual pump IV*a*. This individual pump IV*a* is now in its pressure phase. At the same time, the other pressure spaces (for example 25A to 27A) are acted upon by the individual pump III*a*, which is in its suction phase. The pressure spaces respectively acting in one direction are therefore always subjected to pressure whereas the other pressure spaces are continuously connected with an individual pump which is in its suction phase.

For retarded adjustment of the camshaft (FIG. 6*c*), the activation of the electromagnet 72 takes place in precisely the opposite manner, i.e. the current to the electromagnet 72 is switched off in the pressure phase of the individual pump III*a* and it is provided with current in the suction phase of the individual pump III*a*.

Figures 6A, 6B, 6C, 6D, 6E:
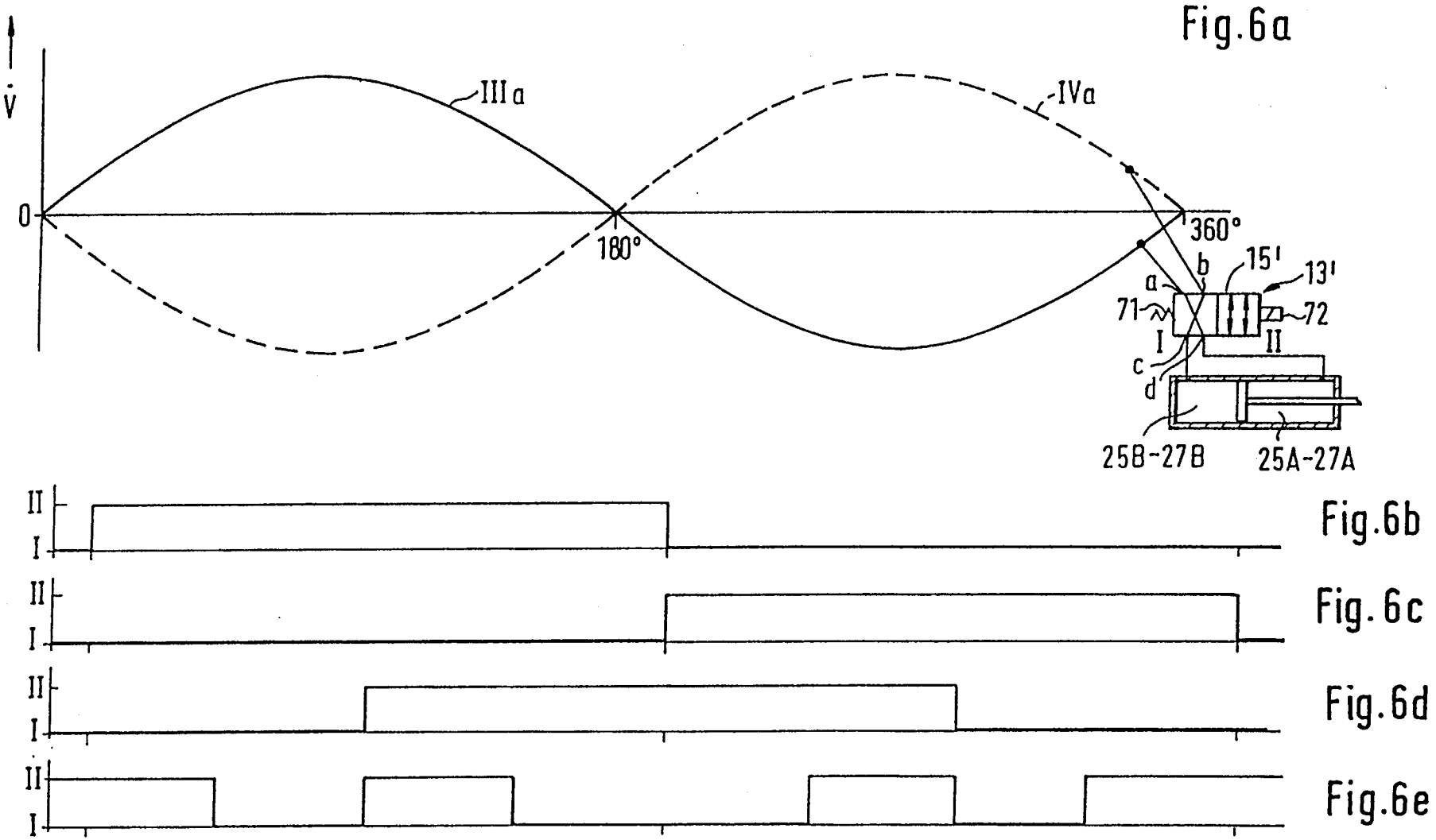

No hydraulic locking of the rotary piston actuator is possible with this pump arrangement and valve configuration. In this case, the activation of the electromagnet 72 is selected in such a way that the rotary piston actuator oscillates around the desired required position. The activation of the electromagnet can here take place as shown in FIGS. 6*d* and 6*e*. In FIG. 6*d*, the hold phase of the rotary piston actuator and of the camshaft is achieved by one activation pulse per complete angular range (0° to 360°). The activation in this case takes place in the angular range between 90° and 270°. The current to the electromagnet 72 is switched off in the angular range between 270° and 450° or 90°.

Large control deviations are, however, caused by such activation of the electromagnet. In order to minimize these large control deviations, the electromagnet 72 can be activated with short control pulses—as illustrated in FIG. 6*e*. A plurality of control pulses distributed over the complete revolution of an individual pump is in this case supplied to the electromagnet 72 so that action is taken against the control deviations of the camshaft. The individual control pulses are advantageously applied in time sequence and duration in such a way that they are respectively equal in the pressure phase and the suction phase of an individual pump.

Figures 7A, 7B, 7C, 7D, 7E:
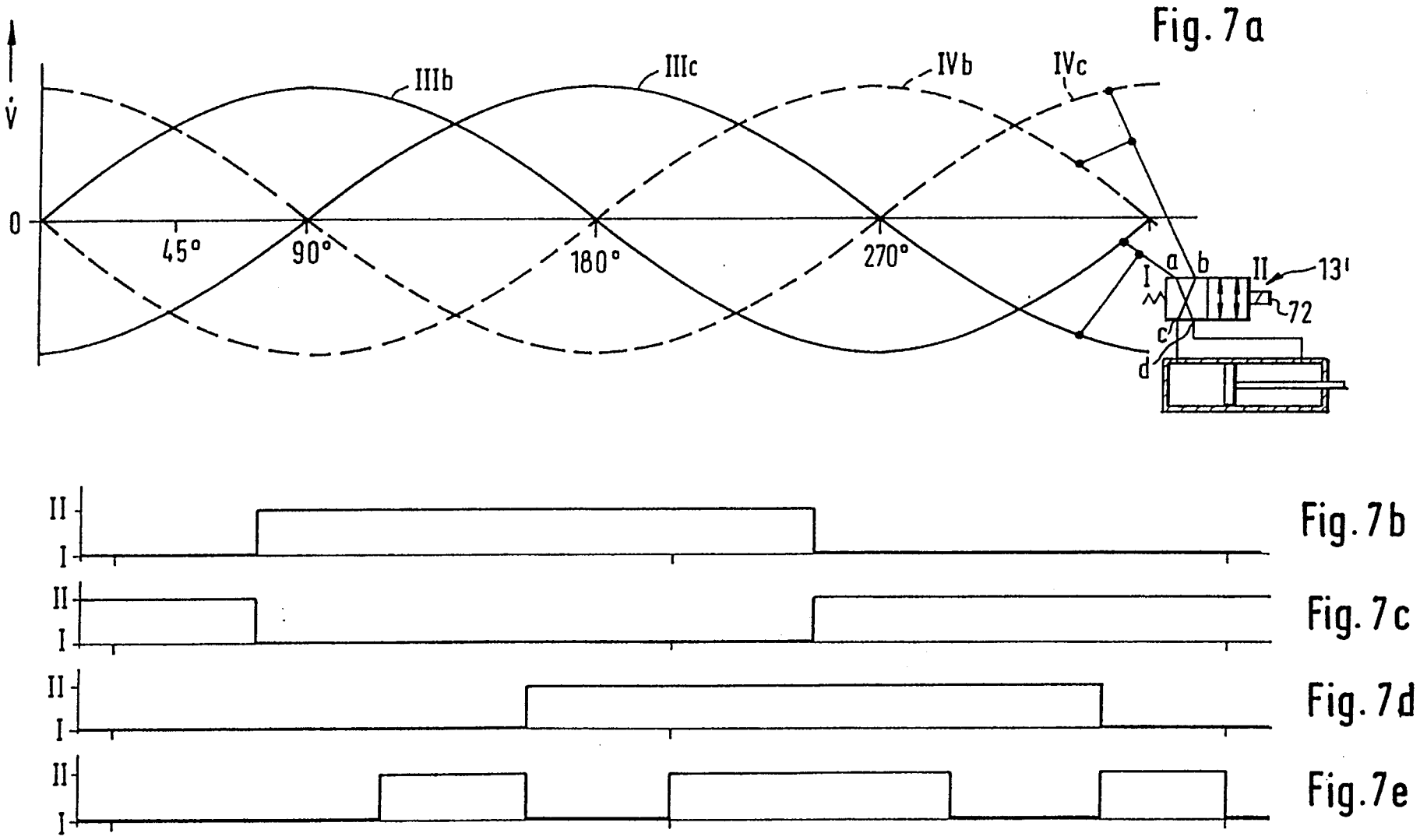

In a manner analogous to the embodiment examples previously described, it is also possible for the pumps to be composed of four individual pumps III*b*, III*c*, IV*b* and IV*c* which are respectively offset by 90° relative to one another. The delivery flow curve of such a pump composed of four individual pumps is shown in FIG. 7*a*. The two individual pumps III*b* and III*c* are then connected to the connection a of the control valve 13' and the two other individual pumps IV*b* and IV*c* are correspondingly connected to the connection b. The activation of the electromagnet 72 is shown in FIGS. 7*b* to 7*e*, FIG. 7*b* showing the activation necessary for an advanced adjustment. FIG. 7*c* correspondingly shows an activation for a retarded adjustment of the camshaft and FIG. 7*d* and 7*e* show the activations of the electromagnet 72 in the hold phase.

For an advanced adjustment, an activation of the electromagnet 72 takes place in the angular range between 45° and 225°. The current to the electromagnet 72 is switched off over the angular range between 225° and 405° or 45°. At a rotational angle of 45° the individual pump III*b* is in its pressure phase and the individual pump III*c* connected to it is in its suction phase. The suction volume of the individual pump III*c* and the pressure volume of the individual pump III*b* complement each other to zero at this moment.

The same applies to the individual pumps IV*b* and IV*c*, the individual pump IV*c* being in its pressure phase and the individual pump IV*b* being in its suction phase. The activation is selected in such a way that, in a manner analogous to that described in FIG. 4*b*, the activation takes place as long as the volume flow sum of the individual pumps IIIb and III*c* is positive and, at the same time, the volume flow sum of the individual pumps IV*b* and IV*c* is negative. If the signs of the volume flow sums of the two individual pumps respectively connected to one another reverses (at a rotational angle of 225° of the individual pump III*b*), the current to the electromagnet 72 is switched off so that the control valve 13' is moved into its neutral position I. In this neutral position I, the association with the individual pressure spaces is exchanged—as previously described—so that an adjustment continues to take place.

The activation of the electromagnet takes place in precisely the opposite manner for a retarded adjustment of the camshaft, as shown in FIG. 7*c*, i.e. no current is supplied to the electromagnet in the angular range between 45° and 225° and it is activated in the angular range between 225° and 405° or 45°.

As in the case of the previous embodiment example, activations with large control deviations (FIG. 7*d*) and activations for small control deviations (FIG. 7*e*) are possible for the hold phase of the camshaft. In the case of the activation of FIG. 7*d*, an individual control pulse is provided to the electromagnet in the angular range between 135° and 305°. The activation takes place in such a way that the rotary piston actuator oscillates about its required position. In the case of the activation of FIG. 7*e*, a plurality of short control pulses is distributed over the angular range so that control deviations of the camshaft and of the rotary piston actuator from the required position are corrected. The activation can in this case take place in such a way that the correction of the control deviation goes beyond the required position, an "oscillating position" occurring which fluctuates over a small band width about this required value.

In a manner analogous to the embodiment examples previously described, a configuration of the pump with an elliptical cam ring and with two individual pumps offset by 180° and offset axially relative to one another (two-row pump) in each case is also possible. The activation of the individual pumps, if correspondingly allocated, then takes place in a manner analogous to the circuit diagram described in FIG. 6.

The embodiment examples, just described, of the device for adjusting a camshaft with alternating association between the individual pumps and the pressure spaces has the advantage that the complete pump revolution for delivery and adjustment is independent of the individual pump which is currently delivering. By this means, an adjustment can be achieved which is more rapid by a factor of 2 compared with the configurations shown in FIGS. 1 to 5. The control deviation about the required position can be kept small by a rapid-action electromagnet.

Here again, the activation of the electromagnet 72 takes place by means of an electronic control unit which records the actual phase position of the camshaft by means of angular sensors, compares it with the required value and generates a cyclically associated pulse signal while taking account of the instantaneous pump position. The, oil supply takes place through the longitudinal hole 11 in the centre of the camshaft and through the non-return valve 64. The desired retarded adjustment when no current is supplied to the magnetic valve can be achieved by leakage because of the transmitted torque and additionally by means of engine oil pressure on the retarded side, which is supplied through a non-return valve 51.

The complete adjustment device of the setting gear (rotary piston actuator), pump and control valve with electromagnet is compactly constructed as a pre-assembled unit and has only the following interfaces:

the bolting and centering on the camshaft;

the support of the pump cam (cam ring) by means of a simple claw coupling or the like and the electrical connection to the stationary magnet of the electromagnetic valve.

The method described for activating the device for rotating the camshaft and for activating the pressure spaces is not limited to the rotary piston actuator described here. It is also suitable for a device for adjusting the camshaft using a sliding muff and a setting cylinder. In this case the respectively oppositely acting pressure spaces should then advantageously have the same volume.

This method of activation and the device described for rotating a shaft can also, for example, be used in an injection distributor, which can be hydraulically actuated, for injection pumps.

We claim:

1. A device for relative rotation of a cam shaft of an internal combustion engine relative to a drive wheel rotatably arranged on the shaft, the device comprising a hydrostatic pump driven by the drive wheel and supplied with pressure medium from a low pressure circuit of an internal combustion engine; a control valve; a setting element to which said hydrostatic pump supplies the pressure medium via said control valve and which effects a rotation of said shaft and has at least two pressure spaces acting opposite on said setting element when subjected to pressure, said setting element being located within said drive wheel of said shaft and formed as a rotary piston actuator with a hub arranged so that it is fixed on and rotates with a central housing located in a middle of said control valve, a rotor of said hydraulic pump being arranged on a same axis as the rotary piston actuator and being driven by the shaft.

2. A device as defined in claim 1, wherein said hydraulic pump is formed as a radial piston pump.

3. A device as defined in claim 2, wherein said radial piston pump is formed as a ball piston pump.

4. A device as defined in claim 1, wherein said pump has a housing which is torsionally secured to said shaft.

5. A device as defined in claim 1, wherein said control valve is formed as an electromagnetically actuatable valve having an electromagnet activatable by an electronic device influenced by sensors and acting on a control spool arranged so that it is slidable in a spool valve bore of a valve housing.

6. A device as defined in claim 5, wherein said electromagnetically actuatable control valve is a pulsed control valve.

7. A device as defined in claim 1, wherein said control valve is a 4/2-way valve.

8. A device as defined in claim 7, wherein said setting element includes the rotary piston actuator with at least two vanes acted upon by the pressure spaces, said pressure spaces being arranged so that they are subjectable to pressure or relievable via passages formed in said setting element, in a valve housing and said pump.

9. A device as defined in claim 1, wherein said pump is formed as a radial piston pump with at least two pump working spaces acting with offset phases.

10. A device as defined in claim 9, wherein said radial piston pump has four pump working spaces offset by 90° relative to one another.

11. A device as defined in claim 9, wherein said radial piston pump is a two-row pump.

12. A device as defined in claim 1, wherein said control valve and said pump are arranged so that inlet and outlet control of said pump is performed by activation of said control valve matched in phase to suction and delivery cycles.

13. A device as defined in claim 1, wherein a cam ring has an elliptical cam curve.

14. A device as defined in claim 1, wherein said pump has pump pistons and further comprising a cam ring cooperating with said pump pistons and having a cam curve which extends as a circular track which is eccentric to an axis of said shaft.

15. A device as defined in claim 1, and further comprising a sleeve arranged between a pump housing and a valve housing and provided with supply and drain openings for said pump which are connected to said control valve.

16. A method of activating a device for relative rotation of a cam shaft of an internal combustion engine relative to a drive wheel rotatably arranged on the shaft, and having a setting element with at least two pressure spaces oppositely acting on the setting element when subject to pressure, and also having a pump, the method comprising the steps of connecting the pump to the setting element via a control valve, said connecting including connecting the pump via the control valve with one of the pressure spaces of the setting element respectively as a function of a working phase of the pump.

17. A method as defined in claim 16, said connecting includes connecting the pump via the control valve with one of the pressure spaces of the setting element respectively as a function of a suction phase of the pump.

18. A method as defined in claim 16, said connecting includes connecting the pump via the control valve with one of the pressure spaces of the setting element respectively as a function of a pressure phase of the pump.

19. A method as defined in claim 16, wherein said connecting includes connecting the pressure spaces via the control valve to the pump for a setting motion of the setting element in such a way that at least one pressure space is connected with the pump during a suction phase of the pump and the other pressure space is connected with the pump during a pressure phase of the pump.

20. A method as defined in claim 16, and further comprising the step of interrupting a connection between the pump and the setting element via the control valve in a non-transient position of the setting element.

21. A method as defined in claim 20, and further comprising setting the non-transient position of the setting element by cyclically pulsed, opposite action of the pressure spaces.

22. A method as defined in claim 16, and further comprising the step of composing the pump of at least two individual pumps operating off set in phase, said connecting includes connecting the individual pumps to different pressure spaces in one switching position of the control valve.

23. A method as defined in claim 16, and further comprising the step of composing the pump of at least three individual pumps operating off set in phase and connected to form two sum pumps, said connecting including connecting the pressure spaces to the pump by means of a control valve for adjusting the setting element in such a way that at least one pressure space connected to the sum pump is in a suction phase whereas at least one other pressure space is connected to the other sum pump which is in a pressure phase.

24. A method as defined in claim 16, wherein the setting element includes at least four pressure spaces, said connecting including connecting said four pressure spaces respectively to the control valve in such a way that when acted on by pressure, two groups of pressure spaces appear with a common direction of acting on the setting element.

* * * * *